United States Patent [19]

Yoshida

[11] 4,218,906

[45] Aug. 26, 1980

[54] MATERIAL TENSIONING METHOD AND APPARATUS

[76] Inventor: Keiichiro Yoshida, 641 Mobara, Mobara City, Chiba Prefecture, Japan

[21] Appl. No.: 968,971

[22] Filed: Dec. 13, 1978

[30] Foreign Application Priority Data

Feb. 15, 1978 [JP] Japan ..... 53-16235

[51] Int. Cl.[2] ..... B21D 1/02; B21B 37/08; B21C 1/02

[52] U.S. Cl. ..... 72/183; 100/162 B; 226/186; 72/205; 72/160; 72/289; 29/130

[58] Field of Search ..... 72/183, 465, 205, 160–165, 72/250, 234, 287, 289, 127, 234, 251, 190; 226/186; 100/162 B; 29/113 AD, 116 AD, 130

[56] References Cited

U.S. PATENT DOCUMENTS

| | | | |
|---|---|---|---|
| 1,563,130 | 11/1925 | Weston | 100/162 B |
| 2,696,907 | 12/1954 | Fisk | 226/186 X |
| 2,950,507 | 8/1960 | Keyser | 100/162 B |
| 3,881,233 | 5/1975 | Schmidt et al. | 29/130 X |

*Primary Examiner*—Milton S. Mehr

*Attorney, Agent, or Firm*—Wenderoth, Lind & Ponack

[57] ABSTRACT

For use in drawing, straightening or stretching a strip of metallic material such as bars, wire, and coils, an apparatus having a pair of elastic ring-equipped roll assemblies which provide a high tensioning force for the strip material held therebetween. As the tensioning force increases, the elastic ring in each of the roll assemblies tends to deform elastically along the circumferential direction of the area which contacts the material, thus increasing the contact area over which the applied force is evenly distributed. By this means the force per unit area can be reduced. The elastic ring is mounted on a control driving shaft by at least three axially rotatable rollers, two of which are arranged to bridge the area of the material contacted by the ring.

4 Claims, 12 Drawing Figures

MATERIAL TENSIONING METHOD AND APPARATUS

BACKGROUND OF THE INVENTION

1. Field of the Invention

The present invention relates generally to processing a strip of metallic stock under an applied high tension, and more particularly to a method and apparatus which provides a high tensioning force for a material drawing, straightening or stretching process. The apparatus comprises a pair of elastic ring-equipped roll assemblies, and the ring in each of the roll assemblies is designed to deform elastically with increasing tension which elongates the area of the ring in contact with the material along the circumference of the ring. As a result, the force applied to the material is evenly distributed, thus reducing the force per unit area. The material can be finished to desired dimensions without any damage.

2. Description of the Prior Art

In the art of drawing, straightening or stretching a strip of metal such as a bar or coil stock of a round, square or any other cross section, there is no known method or apparatus which can provide a high tension for processing the stock without causing damage to the stock material. If high tension were applied to the material by a known method or apparatus, would be very likely to be damaged by the rollers or similar means which hold and pull it therebetween. The damage would more frequently tend to occur and become more significant as the tensioning force is increased. For this reason, it is the practice to provide additional means to prevent such damage. For example, when a material is subjected to different tensile forces by the tensioning apparatus, a preliminary disadvantageous provision must be made so as not to damage the material when it is placed under the maximum applied tensile force.

SUMMARY OF THE INVENTION

To overcome the problems of the prior art, the present invention provides a new and improved stock tensioning method and apparatus for use in drawing, straightening or stretching a strip of material. This object of the present invention is achieved by the provision of an elastic ring-equipped pressure roll apparatus which comprises a pair of elastic ring-equipped rolls which provide the high tension for a material but avoid damage to the material under even the maximum tension.

In order to accomplish this object, each of the rings is mounted on a supporting shaft by a plurality of regularly-spaced rollers, and is designed so that the area in contact with the material is increased due to elastic deformation of the rings as the applied tension or pressure increases. The increased area of the ring can evenly distribute the amount of the applied force thereover, resulting in a reduction in the force per unit area which is applied to the material. The aforementioned rollers interposed between the ring and shaft consist preferably of three rollers, two of which are constructed to bridge the area of the material contacted by the ring.

BRIEF DESCRIPTION OF DRAWINGS

Other objects and advantages of the invention will become apparent from the detailed description of several preferred embodiments which will be given hereinafter with reference to the accompanying drawings, in which.

DETAILS OF SEVERAL PREFERRED EMBODIMENTS

Figure 2:
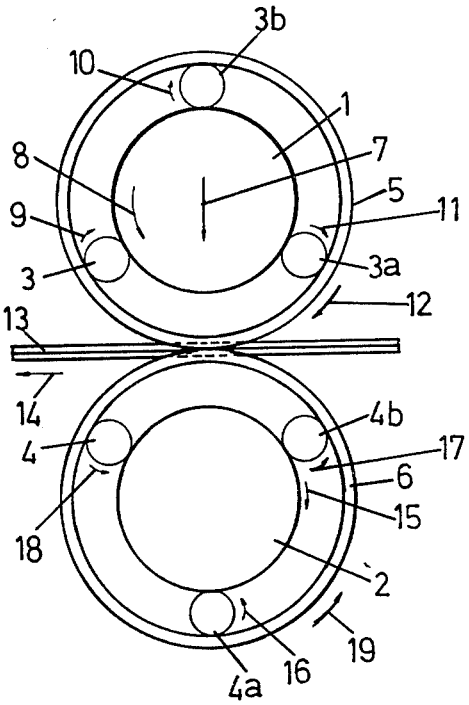
FIG. 2 is a side elevation of a preferred embodiment of the present invention.

Referring to FIG. 2, the apparatus according to the present invention comprises a pair of parallel upper and lower horizontal driving shafts 1 and 2, each of the driving shafts having a set of idle rollers spaced at equal intervals therearound, designated by 3, 3*a* and 3*b* and 4, 4*a* and 4*b*, and elastic rings 5 and 6 fitted over the respective sets of idle rollers. The two rollers 3 and 3*a*, or 4 and 4*b* in each set have a different function from the rollers 3*b* and 4*a*, which will later be described in more detail. The driving shafts 1 and 2 are powered by an external power source (not shown) for causing rotation of the shafts in opposite directions, and at least one of the shafts is constructed so that it can be moved down in the direction of the arrow 7 in FIG. 2 to provide a pressure upon a material.

The embodiment described above is operated in the following manner. The driving shaft 1 is driven so as to rotate in the direction of the arrow 8, causing an axial rotation of the idle rollers 3, 3*a* and 3*b* in the directions of arrows 9, 10 and 11, respectively. The rotation of the rollers 9, 10 and 11 causes a rotation of the elastic ring 5 in the direction of the arrow 12. As will be understood, the driving shaft 2 is also driven concurrently with the shaft 1 and is rotated in the opposite direction, and all the involved elements are rotated in the same manner as is the case with the shaft 1, as indicated by arrows 16, 17, 18 and 19. Thus, a strip of material 13, such as the bar shown, can be moved in the direction of the arrow 14. It has been described that both the shafts 1 and 2 are powered for rotation, but alternately only the shaft 1 may be driven and the other shaft 2 mounted for free rotation.

Figure 3:
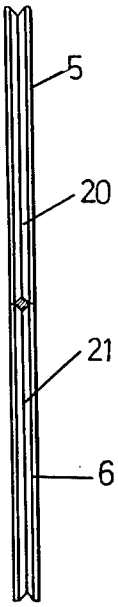
FIG. 3 is an end view of a pair of elastic rings.

As shown in FIG. 3, the elastic rings 5 and 6 are V-grooved at 20 and 21, respectively, around the outer peripheries thereof so as to conform to a bar stock 13 having a square cross-section. These elastic rings may be replaced by other elastic rings which are provided with any peripheral shape in cross-section depending upon the shape of the cross-section of the material to be processed, such as round, flat, etc. Three idle rollers are shown and described, but the number of such rollers is not limited to the described embodiment and may be varied, for example four may be provided. The essential thing is the arrangement of two rollers 3 and 3*a*, or 4 and 4*b*; the two rollers are arranged such that a triangle with two equal sides is formed by imaginary lines connecting the centers of the rollers and the mid-position of that area of the ring which contacts the material. In other words, the two rollers are located at equal distances from said mid-position, or viewed from the contact area of the ring, said mid-position is located exactly between the two rollers. Functionally, the two rollers bridge the area of the material contacted by the ring. The other rollers 3*b* and 4*a* are functionally different from the above described bridging rollers 3 and 3*a* and 4 and 4*b*, acting as slip preventing rollers to prevent the ring from slipping out of position.

Figure 1:
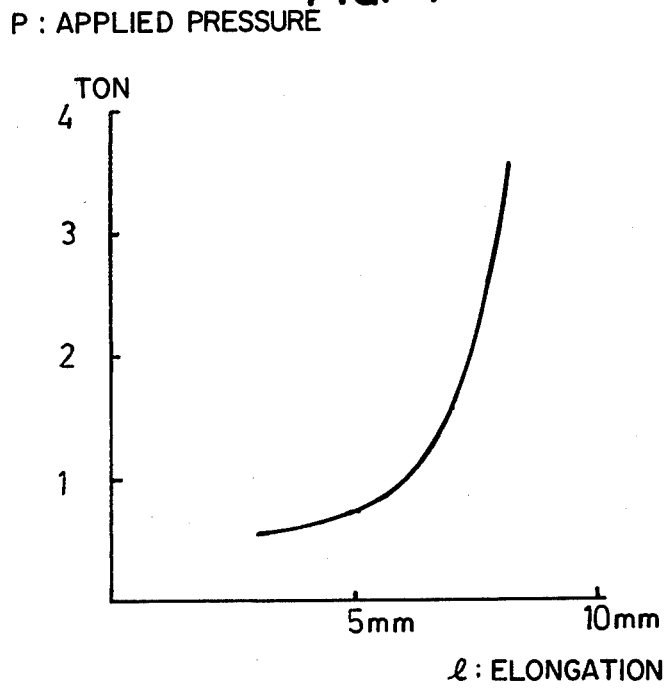
FIG. 1 is a graph illustrating the relationship between the applied pressures and resulting longitudinal elastic deformation of the elastic ring.

The graph in FIG. 1 represents the results of an experiment with a pair of elastic rings 5 and 6 in the apparatus according to the invention. The experiment was carried out with the following parameters:

| | |
|---|---|
| Elastic ring material: | bearing steel; Young's modulus 0f 21,00 kg/mm$^2$; outer diameter of 321 mm; inner diameter of 300 mm; thickness of 10.5 mm. |
| Material or stock to be proceeess: | 12.3 mm wide and 1.7 mm thick; tensile strength of 55 kg/mm$^2$. |
| Applied pressure: | 2.5 tons |

The stock held between the elastic rings was placed under the pressure described above, and the experiment shows that that area of the elastic ring in contact with the stock was elongated in the longitudinal direction of the stock due to the elastic deformation of the ring, the resulting length l being equal to approximately 7.0 mm. When the areas of contact between the rings and the stock were lubricated, a tension of up to 450 kg could be applied to the material with no accompanying damaging effect of the rings upon the material. That is to say, the experiment shows there is no danger of the rings causing damage to the stock under that applied tension or affecting the thickness of the stock which would usually change if rolled.

Figure 10:
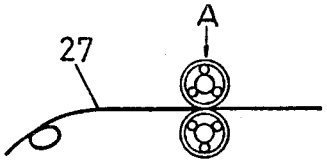
FIGS. 7 through 12 are schematic diagrams illustrating examples of apparatus in which the invention is employed, FIG. 7 being a continuous stretching machine, FIG. 8 being a straightening machine, FIG. 9 being a drawing machine, FIG. 10, being a wire flattening machine, FIG. 11 being a rolling machine and FIG. 12 being a drawing machine in which a material is back-tensioned.
Figure 11:
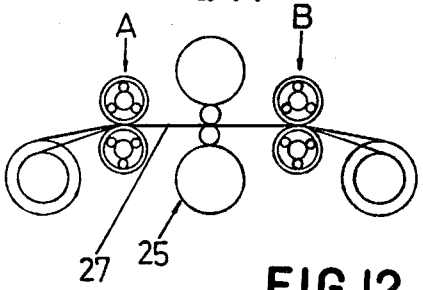
Figure 12:
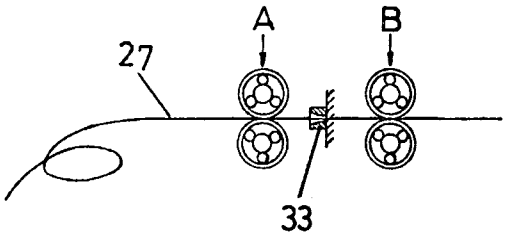
Figure 7:
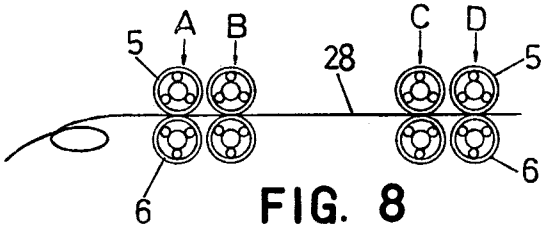
Figure 8:
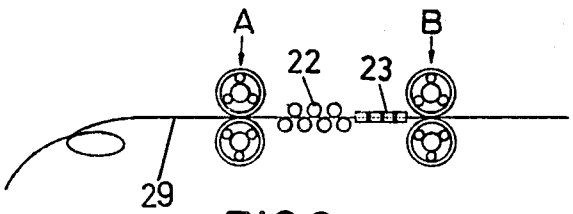
Figure 9:
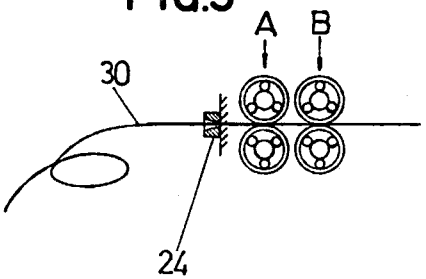

The apparatus constructed according to the present invention has a variety of uses as shown in FIGS. 7 to 12. FIG. 7 shows a continuous stretching machine in which two sets of two pairs of elastic ring-equipped rolls A and B, and C and D are arranged in series along the path of travel of a strip material 28. The high-tension straightening machine in FIG. 8 incorporates two pairs of elastic ring-equipped rolls A and B spaced apart, and a number of leveler rollers 22 and 23 interposed between the two pairs for removing strains from the strip material 29. FIG. 9 shows a drawing machine including a die 24 with two pairs of elastic ring-equipped rolls A and B disposed on the outlet side of the die for obtaining the desired diameter of a strip material 30. In FIG. 10, one pair of elastic ring-equipped rolls is employed for producing a flattened wire material 27. In connection with the application in FIG. 10, it is known that the greater the diameter of the rolls or the more passes, the better the width precision of the resulting product. A larger number of passes is not practical from an economical standpoint, however. The use of the ring rolls as shown in FIG. 10 can provide the same result as a large number of rolls or more passes. FIG. 11 shows a high-tension rolling mill including multi-stage rolls 25 with two pairs of elastic ring-equipped rolls A and B one pair on each side of the multi-stage rolls 25. This structure permits a reciprocating movement of the strip material 27. In the arrangement of FIG. 11, the part of the material located between the ring rolls A and B is tensioned so that it is possible to reduce the compressive force that the material exerts on the winding drums when being wound in layers, thereby avoiding breakage of the drums due to the compressive force. FIG. 12 shows an application in which one of the two pairs of elastic ring-equipped rolls A and B is installed on each side of a die 33, and the pair A applies a braking torque for placing the part of the material 27 between the pair A and the die 33 under a back tension. Thus, the overall compressive force exerted on the die can be reduced.

Figure 4:
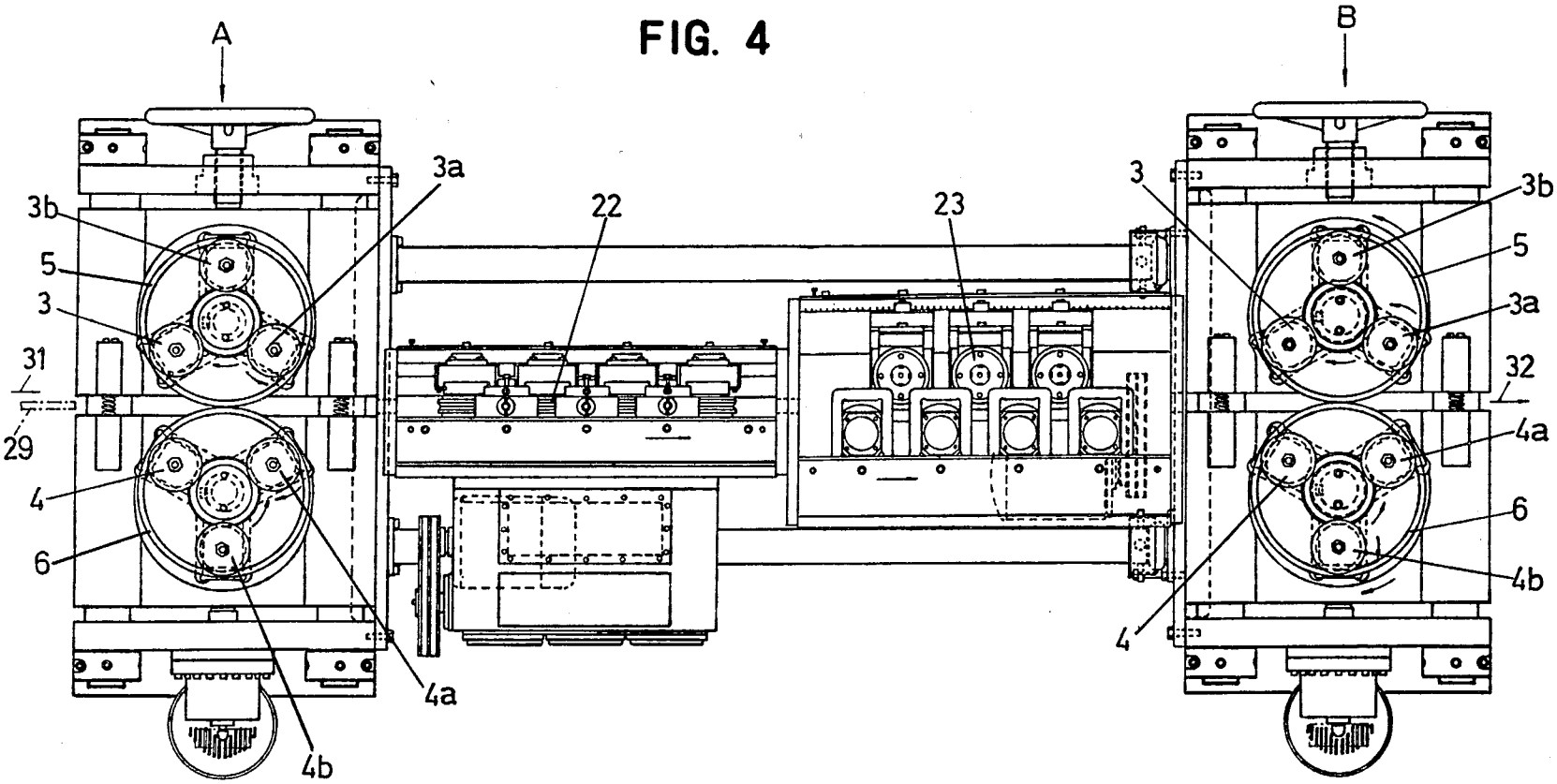
FIG. 4 is a plan view of a straightening machine incorporating the apparatus of the invention.
Figure 5:
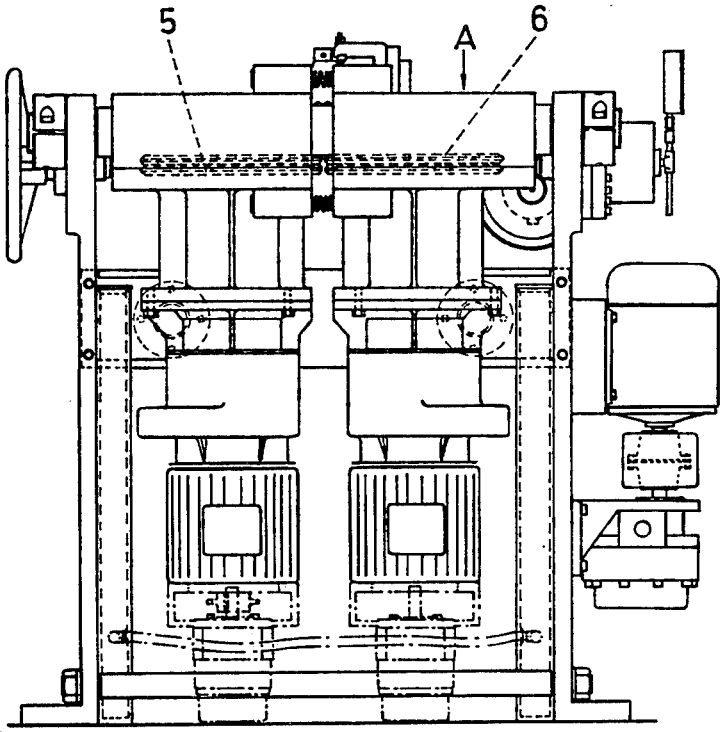
FIG. 5 is an end view of the machine of FIG. 4.
Figure 6:
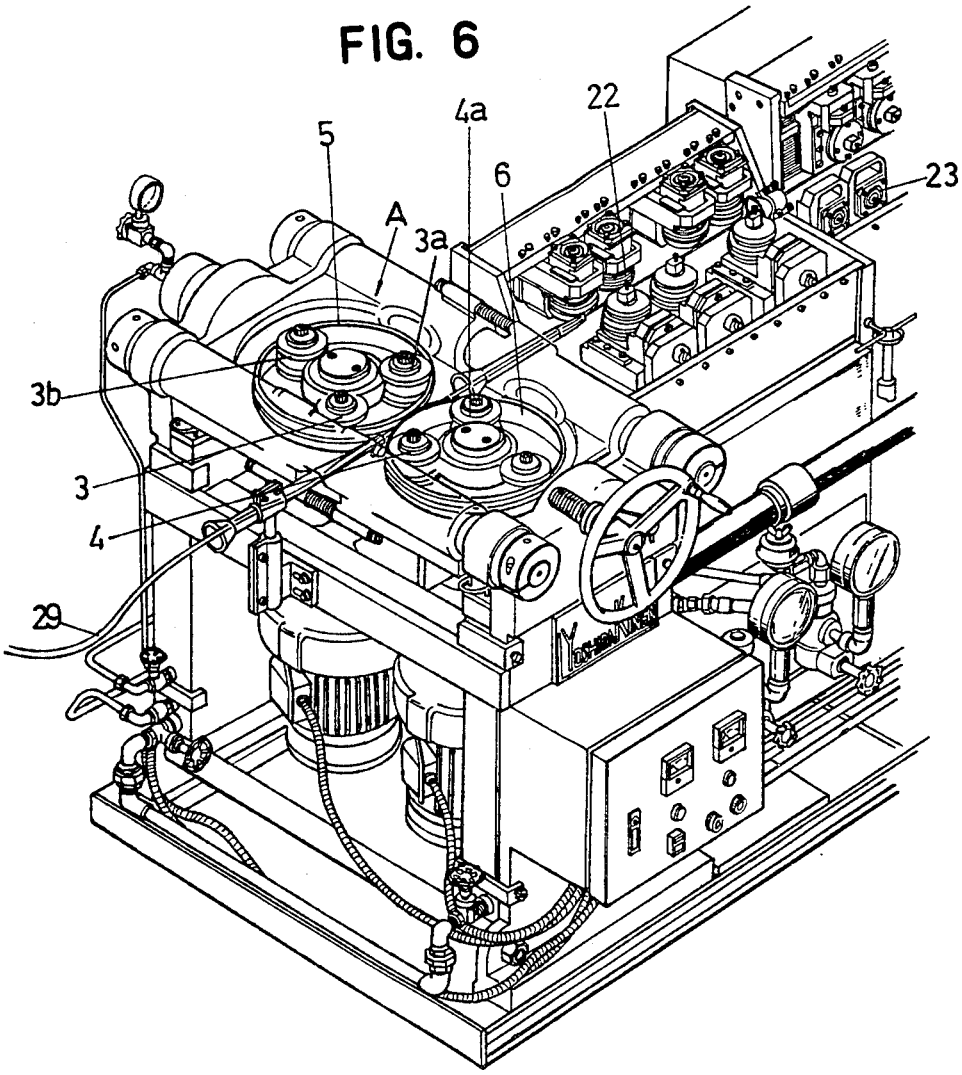
FIG. 6 is a perspective view of part of the machine of FIG. 4, shown on an enlarged scale.

The construction shown in FIGS. 4 to 6 is a specific embodiment of the apparatus shwon schematically in FIG. 8. The material to be processed is a stainless steel flat bar 13 mm wide and 3 mm thick having a tensile strength of 80 kg/mm$^2$. It is shown from the measured results that a curvature in the direction of the width over a 1 m length of the material can be straightened to within 0.3 mm as measured by a scale, and a curvature in the direction of the thickness can be straightened so as to make a 0.15 mm thickness gauge insertable. A material previously twisted through an angle of 180 DEG over a length of 3 m was passed through the machine, and the result was that the twisted material was untwisted to a straight line in a single pass, this being satisfactory as measured by a scale. In the machine shown in FIGS. 4 to 6, two pairs of the elastic ring-equipped rolls A and B described heretofore are mounted, one pair on each side of the machine, and two sets of a number of leveler rollers 22 and 23 are mounted between the pairs A and B, the first set having rollers disposed in a horizontal position for specifically correcting a lateral curve of a material 29, and the other set having rollers disposed in a vertical position for correcting a vertical curve. The ring-equipped roll pairs A and B are set to rotate a proper number of revolutions which provide a proper amount of tension for the part of the material between the two roll pairs A and B. Driving the ring roll pairs at the set rate of speed causes the strip material to be fed into the machine and through the first pair A and the leveler rollers 22 and 23 into the second pair B. Then, the strip is placed under the set high tension, and is drawn out of the second pair B as indicated by arrow 32. The thus obtained material is a straightened product.

As can be readily understood from the foregoing description, the present invention is advantageous in that the material to be processed can be subjected to the maximum high tension without having a permanent strain or deformation in the portion thereof held between the elastic ring rolls since the areas of the rings in contact with the material increase with the increasing amount of the tensile force, and the total applied force can therefore be distributed over the increased areas which results in a reduced force per unit area.

Although the present invention has been described with reference to the several embodiments thereof, it should be understood that various changes and modifications may be made without departing from the spirit and scope of the invention.

I claim:

1. A material tensioning apparatus for placing a continuous strip of material or stock under an applied high tension for a drawing, straightening or stretching process, comprising:

a pair of parallel horizontal upper and lower driving shafts;

a pair of elastic metallic rings rotatably mounted on the respective driving shafts and having peripheral portions opposed to each other for holding the material therebetween, each elastic metallic ring being sufficiently elastic for having an elastic deformation for increasing the area of said rings in contact with the material in the direction of the circumference of said ring as force applied from said ring to the material increases; and a plurality of axially rotatable rollers interposed between each driving shaft and each ring and rotatably supporting said rings on said driving shafts and engaging said driving shafts and said rings for rotatably driving said rings from said driving shafts, two adjacent rollers of said rollers in each plurality being positioned at substantially equal peripheral distances on opposite sides of the point at which said rings contact the material being tensioned.

2. A material tensioning apparatus as claimed in claim 1 wherein there are three rollers in each set.

3. A material tensioning apparatus as claimed in claim 1 wherein the outer periphery of each of said rings has a cross-sectional shape complementary to that of the material being tensioned.

4. A material tensioning apparatus as claimed in claim 1 wherein at least one of said driving shafts is movable toward and away from the other driving shaft for adjusting the force with which said rings contact the material being tensioned.

* * * * *